US008347649B1

(12) United States Patent
Gavin et al.

(10) Patent No.: US 8,347,649 B1
(45) Date of Patent: Jan. 8, 2013

(54) DOOR SEAL ARRANGEMENTS AND METHODS

(75) Inventors: Jesse A. Gavin, Poynette, WI (US); Bryan Davis, Madison, WI (US); Robert Wayne Fessenden, Lodi, WI (US); Dennis Conohan, Cross Plains, WI (US)

(73) Assignee: Alkar-RapidPak-MP Equipment, Inc., Lodi, WI (US)

( * ) Notice: Subject to any disclaimer, the term of this patent is extended or adjusted under 35 U.S.C. 154(b) by 1209 days.

(21) Appl. No.: 12/174,749

(22) Filed: Jul. 17, 2008

(51) Int. Cl.

| | |
|---|---|
| ***F25D 11/00*** | (2006.01) |
| ***F25D 11/02*** | (2006.01) |
| ***B65D 45/30*** | (2006.01) |
| ***E06B 7/18*** | (2006.01) |
| ***E05F 7/02*** | (2006.01) |

(52) U.S. Cl. .... 62/440; 62/441; 292/256.65; 292/307 R; 49/477.1; 49/276

(58) Field of Classification Search ..... 62/100, 62/169, 441, 449; 292/256.65, 307 R; 49/477.1
See application file for complete search history.

(56) References Cited

U.S. PATENT DOCUMENTS 3,745,707 A * 7/1973 Herr ..... 49/449

FOREIGN PATENT DOCUMENTS

GB 2392469 A * 3/2004

OTHER PUBLICATIONS

Mechanical Valves—Series VM (5-6-2 through 5-6-34), available at http://www.smcusa.com/sections/products/valves.asp, last visited Feb. 21, 2008.

* cited by examiner

*Primary Examiner* — Mohammad Ali
*Assistant Examiner* — Daniel C Comings
(74) *Attorney, Agent, or Firm* — Andrus, Sceales, Starke & Sawall, LLP

(57) ABSTRACT

A door seal arrangement and method for sealing between a door and a door frame on food processing equipment are provided. The door seal is inflatable to create a seal between the door and the door frame and deflatable to release the seal between the door and the door frame. An air supply applies positive air pressure to the door seal to inflate the door seal. A vacuum applies a negative air pressure to the door seal to deflate the door seal.

10 Claims, 4 Drawing Sheets

DOOR SEAL ARRANGEMENTS AND METHODS

FIELD

The present application relates to door seal arrangements on food processing equipment and methods of sealing between a door and a door frame on food processing equipment.

BACKGROUND

Door seals on food processing equipment commonly include air-inflatable rubber gaskets or other types of inflatable elastic devices that are positioned between a door and a door frame. In many examples, the door seal is disposed around the periphery of the door; however the door seal can also or alternately be disposed around the periphery of the door frame. When the door is closed, an air pump is activated to supply positive air pressure to the door seal, thus causing the seal to inflate into a state wherein the gap between the door and the door frame is sealed. To open the door, the air pressure inside the gasket is released, typically by a release valve. The natural resiliency of the seal forces the air pressure out of the release valve and causes the door seal to deflate back to its natural state.

SUMMARY

The applicant has identified several problems with known door seal arrangements. For example, the deflation process can take a relatively long time to complete. In addition, the natural resiliency of the door seal tends to degrade over time. The longer the seal is actively maintained in its inflated state, the less resilient the seal becomes, further adding to the time required for deflation. Also, partially deflated door seals tend to wear against the door frame, the ground, or adjacent structures, thus resulting in damage. Each of these problems are especially prevalent when known door sealing arrangements are incorporated with food processing equipment, such as cookers and/or chillers, which operate at extreme hot and cold temperatures for extended periods of time.

The present application describes new door seal arrangements and methods that overcome many of the problems associated with the prior art. In one example, a door seal arrangement is provided for sealing between a door and a door frame. The arrangement includes a door seal that is inflatable to create a seal between the door and the door frame and deflatable to release the seal between the door and the door frame. An air supply applies positive air pressure to the door seal to inflate the door seal and a vacuum applies a negative air pressure to the door seal to deflate the door seal.

In one example, a control valve is provided that selectively connects the air supply and the vacuum to the door seal. The valve is positionable in a first position wherein the positive air pressure is applied to inflate the door seal and in a second position wherein the negative air pressure is applied to deflate the door seal. The control valve includes a first conduit that receives positive air pressure from the air supply, a second conduit that receives positive air pressure from the air supply and supplies the positive air pressure to the door seal, and a switching mechanism that selectively connects and disconnects the first and second conduits. Operation of the air supply and connection of the first and second conduits inflates the door seal.

In another example, the control valve includes a third conduit that receives positive air pressure from the door seal, a fourth conduit that receives positive air pressure from the third conduit and provides positive air pressure to the vacuum, and a fifth conduit that receives air pressure from the second conduit and that supplies the air pressure to the vacuum. The switching mechanism selectively connects and disconnects the third and fourth conduits together and the second and fifth conduits together. Operation of the vacuum and connection of the first and fourth conduits and the third and fifth conduits deflates the door seal.

BRIEF DESCRIPTION OF THE DRAWINGS

The best mode of carrying out the invention is described herein, with reference to the following drawing figures.

DETAILED DESCRIPTION OF THE DRAWINGS

FIGS. 1-8 depict door seal arrangements that exemplify the presently claimed invention. It should be noted that the invention described and depicted herein is susceptible to embodiments in many different forms. While this application contains drawings and description that refer to preferred embodiments, the application and drawings are not intended to limit the broad aspects claimed in the appended claims. The concepts set forth herein are not limited for use with the particular sealing arrangement shown and described.

Figure 1:
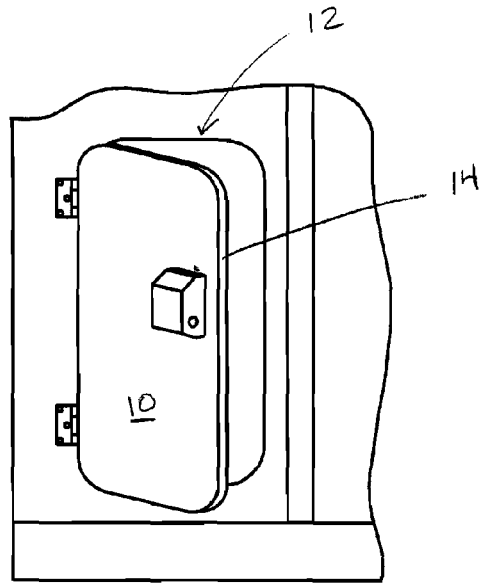
FIG. 1 is a perspective view of a door and door frame, showing the door in the open position.
Figure 7:
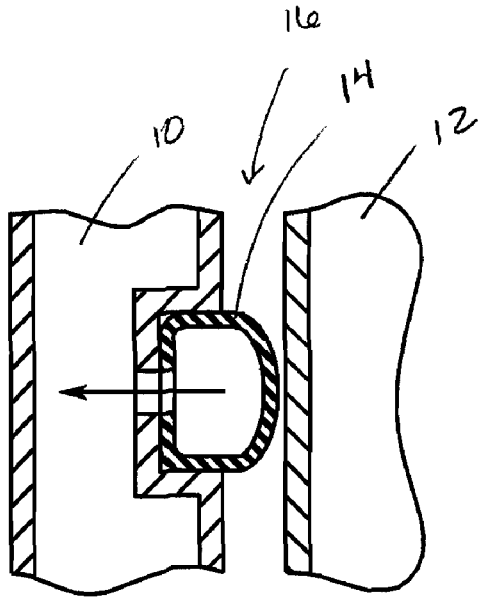
FIG. 7 is a sectional view of the door seal in an unsealed position.
Figure 8:
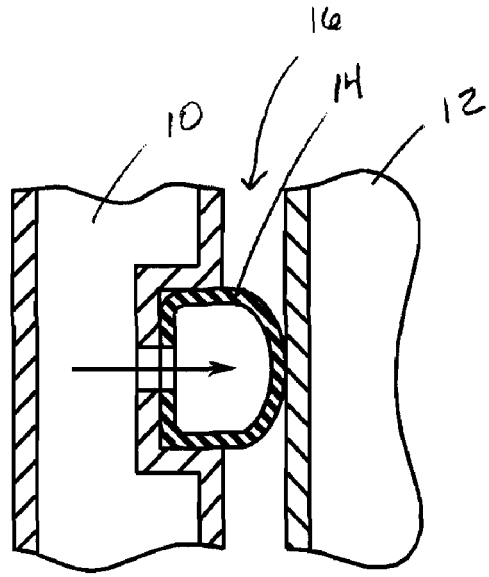
FIG. 8 is a sectional view of the door seal in a sealed position.

FIGS. 1, 7 and 8 depict a door seal arrangement for sealing between a door 10 and a door frame 12. In the preferred embodiment, the door 10 and door frame 12 are part of food processing equipment such as cooking or chilling equipment. One part of the arrangement is a door seal 14 including an inflatable rubber gasket that is disposed around the outer periphery of the door 10. As shown in FIG. 8, the door seal 14 is inflatable to seal the gap 16 between the door 10 and door frame 12. As shown in FIG. 7, the door seal 14 is deflatable to unseal the gap 16 between the door frame 12 and door 10. In one example, the door seal 14 has a natural resiliency that causes the seal 14 to retract into its deflated state, shown in FIG. 7, when the door seal 14 is not subject to a positive air pressure. However as explained further below it is not necessary that the door seal 14 have a natural resiliency.

Figure 2:
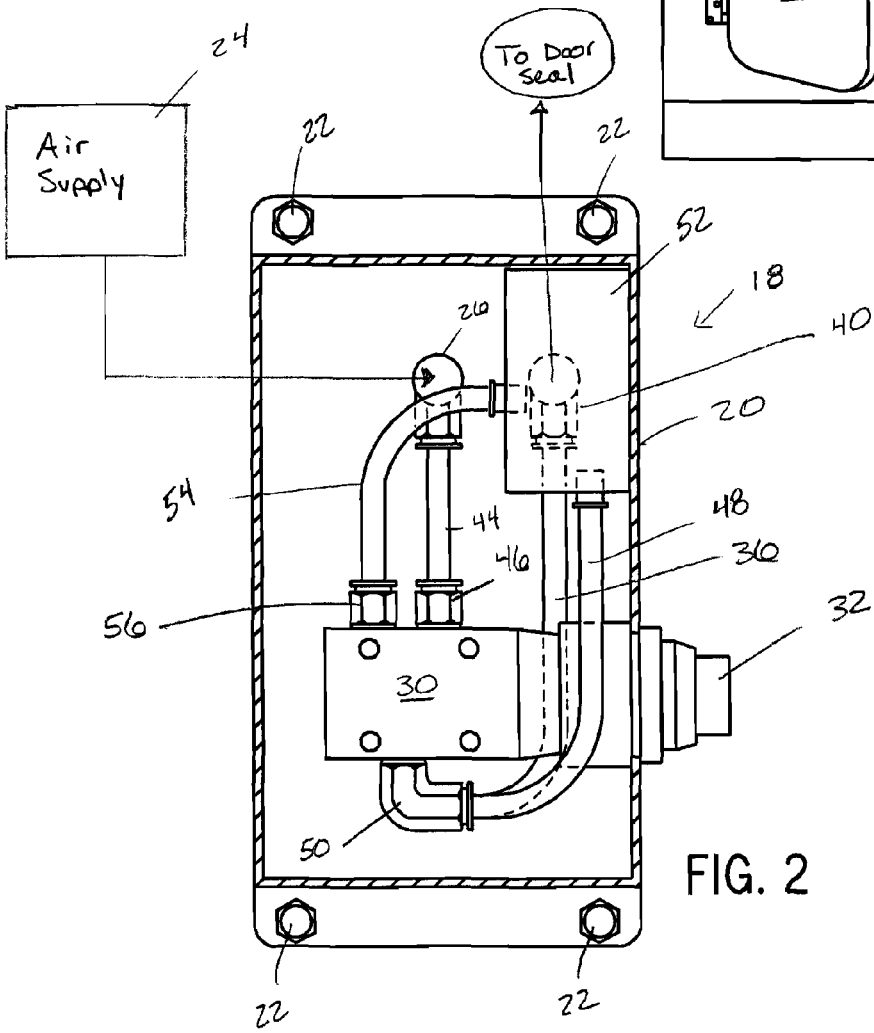
FIG. 2 is a front sectional view of a control valve for a door seal arrangement.
Figure 3:
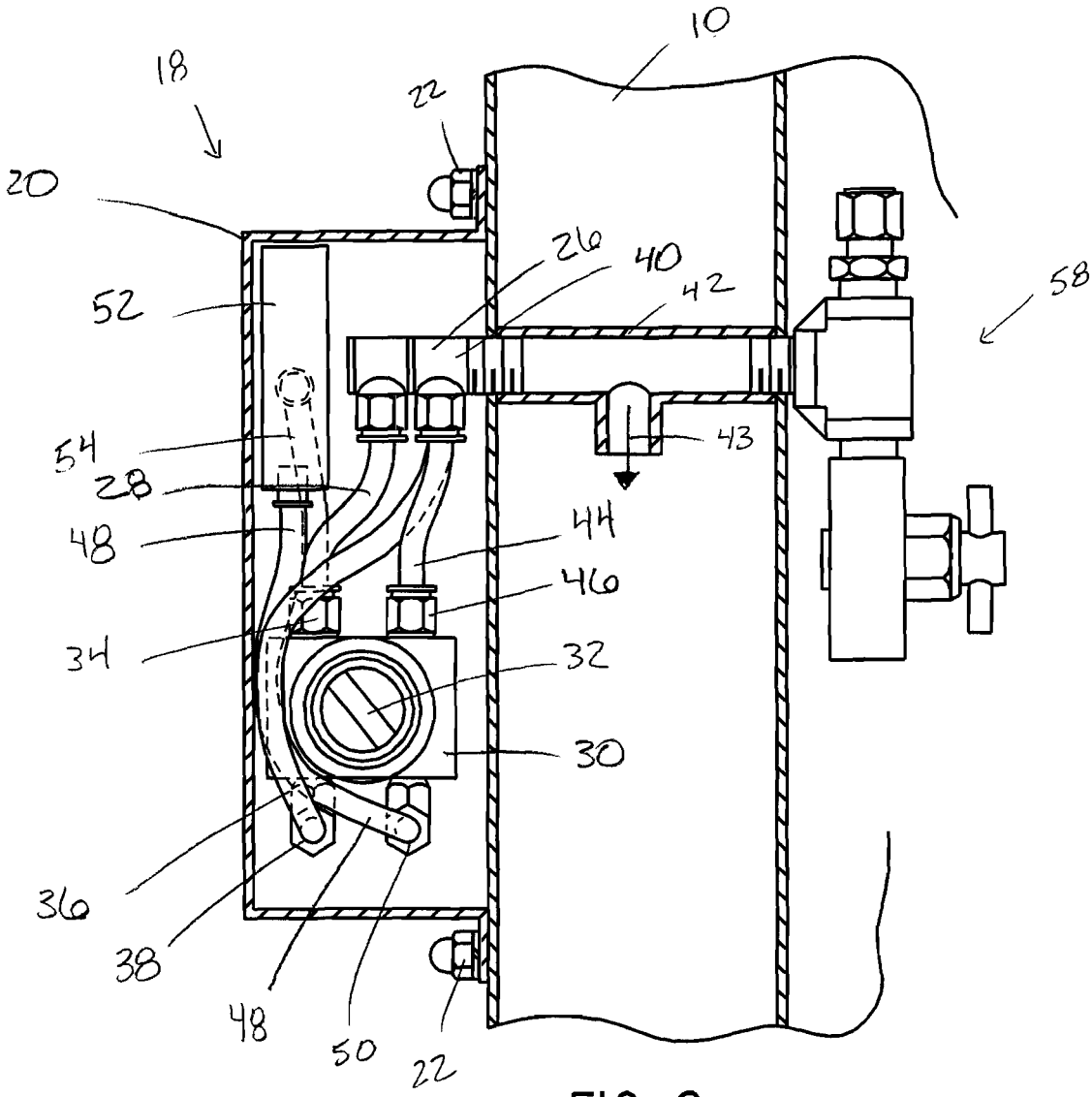
FIG. 3 is a side sectional view of the control valve and door and a side view of an escape valve.

FIGS. 2 and 3 illustrate one example of a control valve 18 that constitutes another part of the door seal arrangement. The control valve 18 is housed in a housing 20 that is attached to the door 10 by a plurality of screws 22. An air supply shown schematically at 24 in FIG. 2 applies positive air pressure to the control valve 18 via fitting tee 26. Fitting tee 26 is attached to a first conduit 28 shown in FIG. 3 that transfers the positive air pressure to a switching mechanism 30, which in the example shown constitutes a three-position mechanical valve that is operated by a rotatable switch 32. The switching mechanism 30 includes a first connection 34 connected to the first conduit 28 and receiving positive air pressure from the air supply 24. A second conduit 36 is connected to a second connection 38 on the switching mechanism 30. The second conduit 36 transfers air pressure to fitting tee 40, which in turn is connected to the door seal 14 via piping 42 as shown schematically in FIG. 3 at 43, which can be located inside the door 10. A third conduit 44 transfers positive air pressure from the air supply 24 via fitting tee 26 to the switching mechanism 30 via a third connection 46. A fourth conduit 48 extends between a fourth connection 50 and a vacuum 52, which in the example shown includes a vacuum pump that operates based upon a venturi effect. A fifth conduit 54 connects between a fifth connection 56 on the switching mechanism 30 and the vacuum pump 52.

As shown in FIG. 3, an escape valve 58 is positioned on the interior of the door 10 and is connected to piping 42 and configured to selectively release air pressure from the door seal 14.

Figure 4:
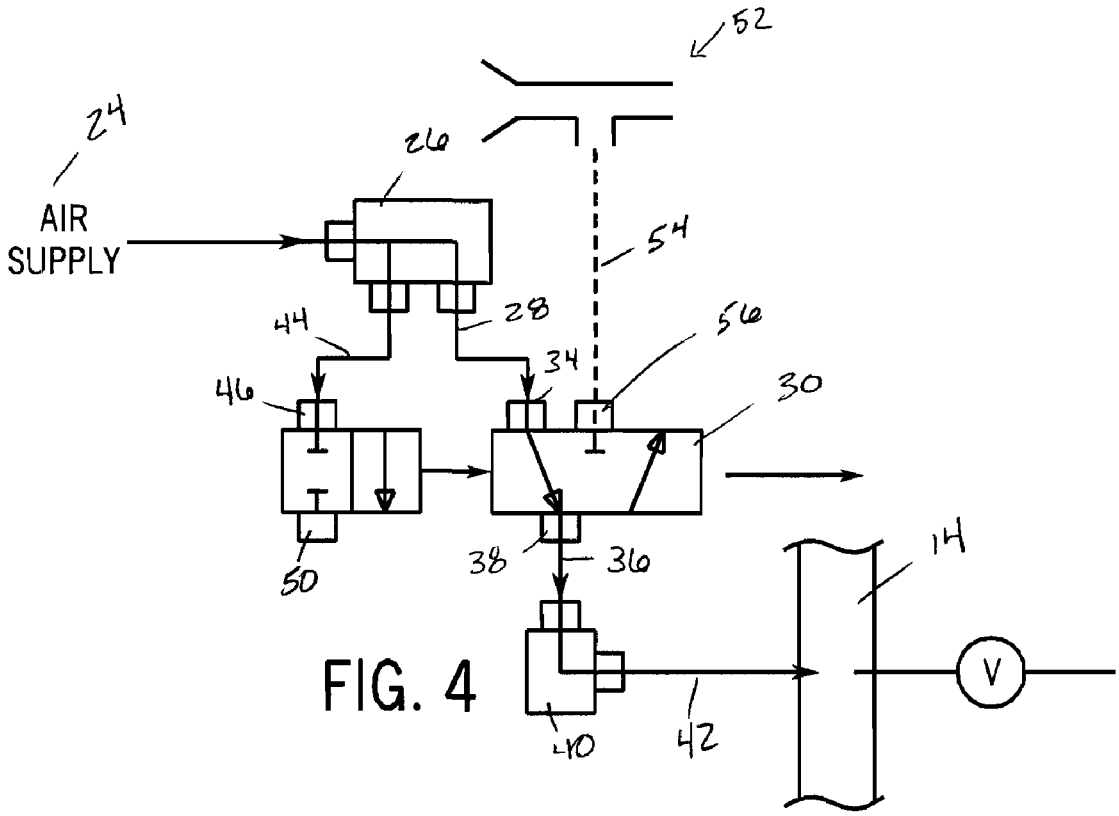
FIG. 4 is a schematic view of the control valve in an open position wherein an air supply applies positive air pressure to the door seal.
Figure 5:
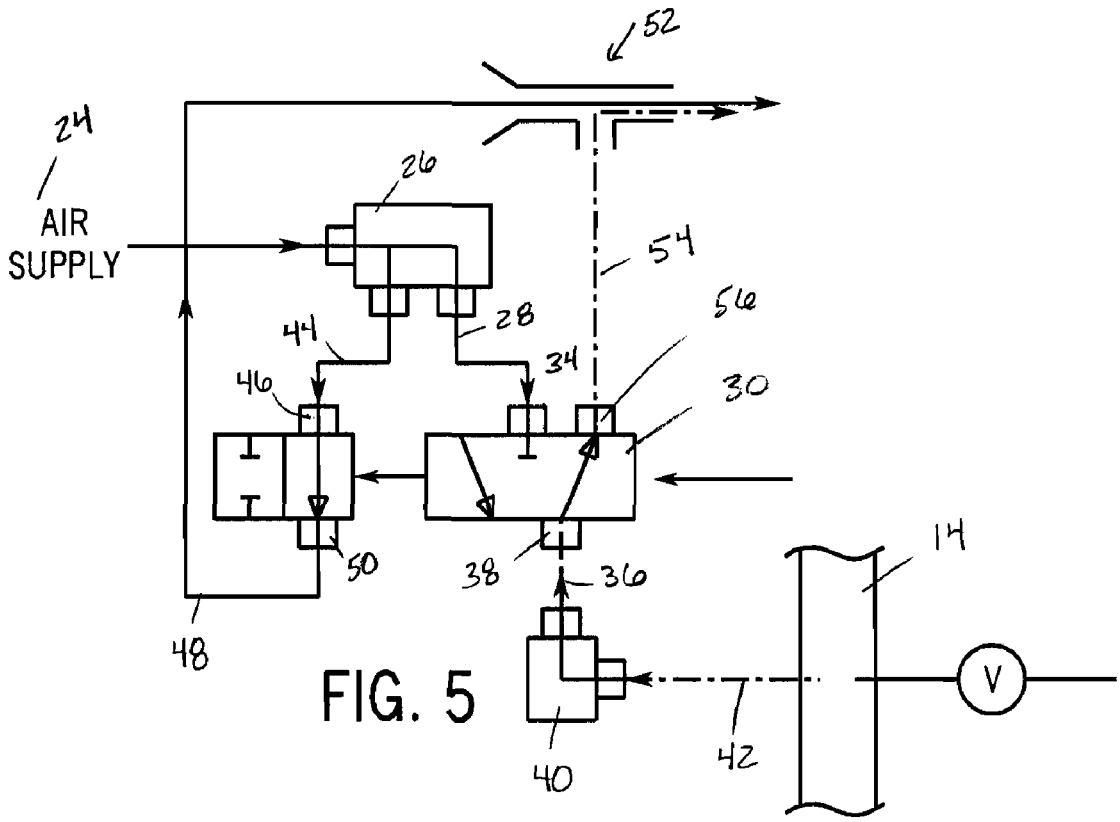
FIG. 5 is a schematic view of the control valve in an open position wherein a vacuum applies negative air pressure to the door seal.
Figure 6:
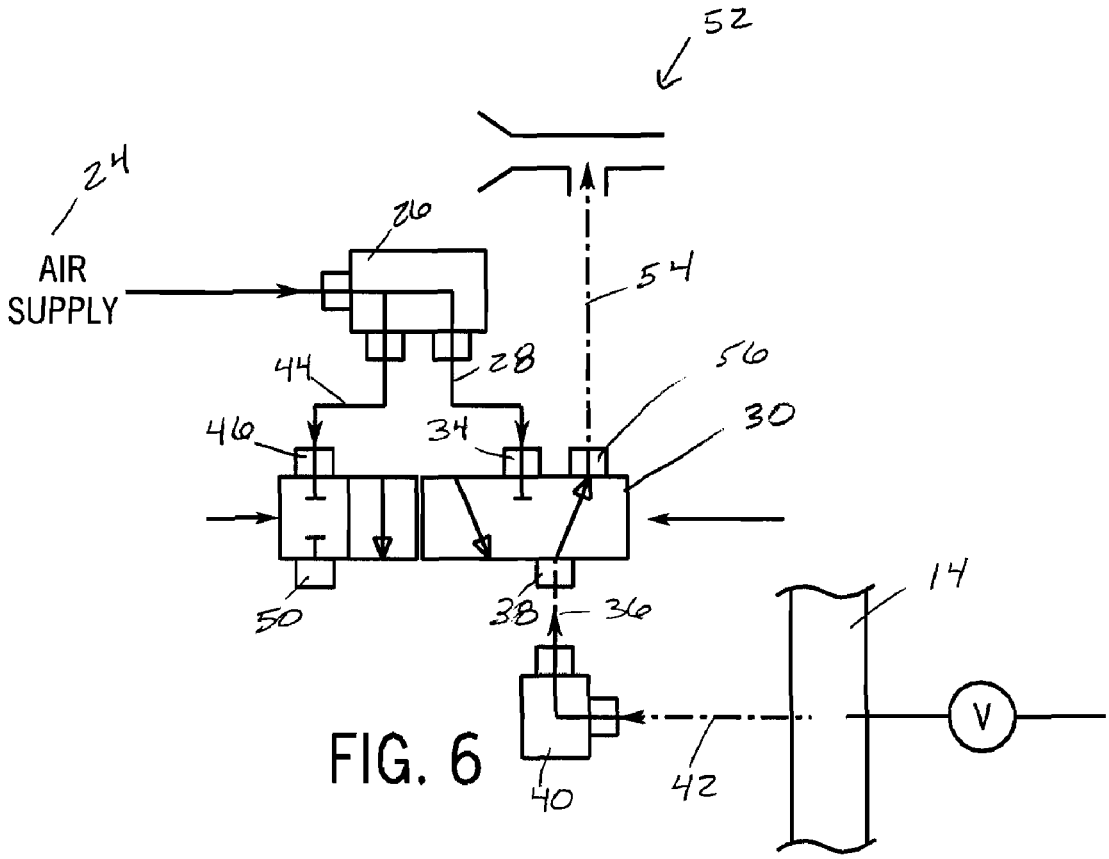
FIG. 6 is a schematic view of the control valve in a closed position.

Principle operations for the illustrated example are shown schematically in FIGS. 4-6. As shown in FIG. 4, the switching mechanism 30 is positionable into a first position wherein positive air pressure is provided from the air supply 24 to the control valve 18 and then further to the door seal 14. More specifically, positive air pressure flows from air supply 24, through the fitting tee 26, through the first conduit 28, and to the switching mechanism 30. Positive air pressure also flows from the air supply 24 to the third conduit 44. The switching mechanism 30 blocks the positive air pressure from flowing out of the third conduit 44 and allows positive air pressure to flow from the first conduit 28 and into the second conduit 36. The air flows out of the second conduit 36 through fitting tee 40 and ultimately passes into the door seal 14 to inflate the seal to its inflated position, shown in FIG. 8.

As shown in FIG. 5, the switching mechanism 30 is positionable into a second position, wherein negative air pressure is applied by the vacuum 52 to the door seal 14 to deflate the door seal 14. More specifically, the third conduit 44 that is receiving positive air pressure from the air supply 24 is connected by the switching mechanism 30 to the fourth conduit 48. The fourth conduit 48 provides the positive air pressure to the vacuum 52. Air flowing though the vacuum 52 creates a venturi effect, which causes air to be drawn from a fifth conduit 54, which in turn draws air from the second conduit 36 and further from the door seal 14. Thus operation of the vacuum 52 and connection of the first conduit 28 and fourth conduit 48 and the third conduit 44 and fifth conduit 54 creates a venturi effect, which causes the door seal to deflate into its position shown in FIG. 7.

As shown in FIG. 6, the switching mechanism 30 is positionable into a third position, wherein neither positive nor negative air pressure is applied to the door seal 14 and the door seal 14 is neither inflated, nor deflated. In this example, the switching mechanism 30 blocks airflow through the first conduit 28 and the third conduit 44. As such, neither the air supply 24 nor the vacuum pump 52 is connected to the door seal 14.

It will thus be recognized that operation of the switching mechanism 30 causes either inflation or deflation of the door seal 14. The air supply 24 and vacuum pump 52 can be operated continuously and the effect of the air supply 24 and vacuum pump 52 on the door seal 14 is determined by the position of the switching mechanism 30. As such, the unique arrangement described by the present application does not rely upon the natural resiliency of the door seal, but rather utilizes a vacuum to actively remove air pressure from the door seal and cause the door seal to deflate into an unsealed position. Problems associated with the prior art regarding resiliency degradation are thus eliminated, which is a particularly important advantage when the door seal is utilized on food processing equipment that operates at extreme temperatures.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Various alternatives and embodiments are contemplated as being with in the scope of the following claims, particularly pointing out and distinctly claiming the subject matter regarded as the invention.

What is claimed is:

1. A door seal arrangement for sealing between a door and a door frame on food processing equipment, the door seal arrangement comprising:

a door seal that is inflatable to create a seal between the door and the door frame on the food processing equipment and deflatable to release the seal between the door and the door frame;

an air supply that applies positive air pressure to the door seal to inflate the door seal;

a vacuum that applies a negative air pressure to the door seal to deflate the door seal;

a control valve that selectively connects the air supply and the vacuum to the door seal, the valve being positionable in a first position wherein the positive air pressure is applied to inflate the door seal and in a second position wherein the negative air pressure is applied to deflate the door seal; and wherein the control valve system comprises a first conduit receiving positive air pressure from the air supply;

a second conduit receiving positive air pressure from the air supply and supplying the positive air pressure to the door seal; and a switching mechanism that selectively connects and disconnects the first and second conduits;

wherein operation of the air supply and connection of the first and second conduits inflates the door seal; and a third conduit receiving positive air pressure from the air supply;

a fourth conduit receiving positive air pressure from the third conduit and providing said positive air pressure to the vacuum; and a fifth conduit receiving negative air pressure from the second conduit and supplying said air pressure to the vacuum;

wherein the switching mechanism selectively connects and disconnects the third and fourth conduits together and the second and fifth conduits together; and wherein operation of the vacuum and connection of the first and fourth conduits and the third and fifth conduits creates the venturi effect, which deflates the door seal.

2. The arrangement of claim 1, wherein the control valve is positionable in a third position wherein neither the air supply nor the vacuum is connected to the door seal.

3. The arrangement of claim 1, wherein the vacuum comprises a vacuum pump.

4. The arrangement of claim 3, wherein the vacuum pump operates based on venturi effect.

5. The arrangement of claim 1, wherein the air supply comprises a pump that provides a constant supply of positive air pressure to the control valve; wherein the vacuum comprises a venturi pump that creates a constant supply of negative air pressure to the control valve; and wherein the door is inflated or deflated based upon operation of the switching mechanism.

6. The arrangement of claim 1, wherein the door seal seals between a door and a door frame on a chiller.

7. The arrangement of claim 1, wherein the door seal seals between a door and a door frame on a cooker.

8. A door seal arrangement for sealing between a door and a door frame, the door seal arrangement comprising:

a door seal that is inflatable to create a seal between the door and the door frame and deflatable to release the seal between the door and the door frame;

an air supply that applies positive air pressure to the door seal to inflate the door seal;

a vacuum that applies a negative air pressure to the door seal to deflate the door seal;

a control valve that selectively connects the air supply and the vacuum to the door seal, the valve being positionable in a first position wherein the positive air pressure is applied to inflate the door seal and in a second position wherein the negative air pressure is applied to deflate the door seal;

vacuum comprises a vacuum pump that operates based on venturi effect;

wherein the control valve comprises a first conduit receiving positive air pressure from the air supply, a second conduit receiving positive air pressure from the air supply and supplying the positive air pressure to the door seal, and a switching mechanism that selectively connects and disconnects the first and second conduits;

wherein operation of the air supply and connection of the first and second conduits inflates the door seal;

wherein the control valve comprises a third conduit receiving positive air pressure from the door seal, a fourth conduit receiving positive air pressure from the third conduit and providing said positive air pressure to the vacuum, and a fifth conduit receiving air pressure from the second conduit and supplying said air pressure to the vacuum;

wherein the switching mechanism selectively connects and disconnects the third and fourth conduits together and the second and fifth conduits together and wherein operation of the vacuum and connection of the first and fourth conduits and the third and fifth conduits creates the venturi effect, which deflates the door seal; and an escape valve configured to selectively release air pressure from the door seal.

9. A method of operating a door seal arrangement for sealing between a door and a door frame on food processing equipment, the method comprising the steps of:

providing a door seal that is inflatable to create a seal between the door and the door frame on the food processing equipment and deflatable to release the seal between the door and the door frame;

operating an air supply to apply positive air pressure to the door seal to inflate the door seal; and operating a vacuum to apply a negative air pressure to the door seal to deflate the door seal, operating a control valve to selectively connect one of the air supply and the vacuum to the door seal, wherein the control valve system comprises a first conduit receiving positive air pressure from the air supply;

a second conduit receiving positive air pressure from the air supply and supplying the positive air pressure to the door seal; and a switching mechanism that selectively connects and disconnects the first and second conduits;

wherein operation of the air supply and connection of the first and second conduits inflates the door seal; and a third conduit receiving positive air pressure from the air supply;

a fourth conduit receiving positive air pressure from the third conduit and providing said positive air pressure to the vacuum; and a fifth conduit receiving negative air pressure from the second conduit and supplying said air pressure to the vacuum;

wherein the switching mechanism selectively connects and disconnects the third and fourth conduits together and the second and fifth conduits together; and wherein operation of the vacuum and connection of the first and fourth conduits and the third and fifth conduits creates the venturi effect, which deflates the door seal.

10. The method of claim 9 wherein the air supply and vacuum are continuously operated.

* * * * *